US011802413B2

(12) United States Patent
Gillis et al.

(10) Patent No.: US 11,802,413 B2
(45) Date of Patent: Oct. 31, 2023

(54) DECK CONSTRUCTION SPOTTER AND CONTAINER COMBINATION

(71) Applicant: OMG, Inc., Agawam, MA (US)

(72) Inventors: Timothy F. Gillis, Florence, MA (US); Frederick A. Enko, Westfield, MA (US); Logan Carlson, Wilbraham, MA (US)

(73) Assignee: OMG, Inc., Agawam, MA (US)

( * ) Notice: Subject to any disclaimer, the term of this patent is extended or adjusted under 35 U.S.C. 154(b) by 137 days.

(21) Appl. No.: 16/992,523

(22) Filed: Aug. 13, 2020

(65) Prior Publication Data

US 2021/0054636 A1 Feb. 25, 2021

Related U.S. Application Data

(60) Provisional application No. 62/888,590, filed on Aug. 19, 2019.

(51) Int. Cl.
*E04F 21/22* (2006.01)
*E04F 15/02* (2006.01)

(52) U.S. Cl.
CPC ..... *E04F 21/22* (2013.01); *E04F 15/02183* (2013.01); *E04F 15/02044* (2013.01)

(58) Field of Classification Search
CPC ..... E04F 21/22; E04F 15/021873; E04F 21/0092; E04F 21/20; E04F 15/02044; B23B 47/28; B23B 2247/12; B23B 47/287; B23B 47/288; B65D 51/28; B65D 51/2807; B65D 51/2857; B65D 51/2878; B65D 2543/0049; B65D 51/24; B65D 75/32;

(Continued)

(56) References Cited

U.S. PATENT DOCUMENTS 4,145,160 A 3/1979 Wiggins
4,421,442 A 12/1983 Lindblad (Continued)

FOREIGN PATENT DOCUMENTS

GB 2560166 A * 9/2018 ..... B25B 23/005
WO 2018158307 A1 9/2018

OTHER PUBLICATIONS

"Cobra Liner. A Revolutionary Guide to Simplify the Installation of Decking Boards," Cobra Deck Fasteners, http://www.cobrafastener.com/wood-decking-board-template.htm>, accessed Jun. 2, 2019.

(Continued)

*Primary Examiner* — Theodore V Adamos
(74) *Attorney, Agent, or Firm* — Alix, Yale & Ristas, LLP

(57) ABSTRACT

A spotter for assembling building structures and a complimentary container. The spotter includes a web and longitudinally opposite flanges with spaced apart legs that define passthrough openings laterally aligned with each other. The web defines one or more holes for guiding a driven fastener through into a building member. The container includes a bottom member defining a primary cavity for holding accessories and a top cover member. The spotter is positionable within the container in a packed position with the web extending over the primary cavity and each flange extending downwardly on a longitudinally opposite side of the primary cavity. The top cover member lies over the spotter to close the top opening of the primary cavity.

20 Claims, 18 Drawing Sheets

(58) Field of Classification Search
CPC .... B65D 75/328; B65D 75/327; B65D 75/34; B65D 75/36; B65D 75/366; B65D 75/367; B65D 75/368
See application file for complete search history.

(56) References Cited

U.S. PATENT DOCUMENTS

| | | | | |
|---|---|---|---|---|
| 4,752,162 | A | 6/1988 | Groh | |
| 4,930,225 | A | 6/1990 | Phillips | |
| 5,384,103 | A | 1/1995 | Miller | |
| 5,407,306 | A | 4/1995 | Klapperich | |
| 5,456,352 | A * | 10/1995 | McQueeny | B65D 5/42 206/223 |
| 7,001,118 | B1 | 2/2006 | Weinstein et al. | |
| 7,044,460 | B2 | 5/2006 | Bolton | |
| 7,189,034 | B1 | 3/2007 | Zeilinger et al. | |
| 7,214,008 | B1 | 5/2007 | Dods et al. | |
| 7,255,230 | B1 * | 8/2007 | Appelbaum | B65D 75/366 206/463 |
| 8,307,564 | B1 * | 11/2012 | Heaton | G01B 3/566 33/476 |
| 8,616,373 | B2 * | 12/2013 | Hansen | B65D 43/169 206/463 |
| 8,651,777 | B2 | 2/2014 | Adkins et al. | |
| 8,793,889 | B2 * | 8/2014 | Hovren | B25B 23/08 33/526 |
| 9,216,847 | B2 * | 12/2015 | Belinda | B65D 51/24 |
| 10,286,458 | B2 | 5/2019 | Brigham | |
| 10,988,947 | B2 * | 4/2021 | Sheppard | G01C 9/34 |
| 2007/0175176 | A1 | 8/2007 | Lane | |
| 2007/0289890 | A1 * | 12/2007 | Appelbaum | B65D 75/366 206/461 |
| 2008/0022629 | A1 | 1/2008 | Behnecke et al. | |
| 2010/0083610 | A1 | 4/2010 | King | |
| 2011/0147381 | A1 | 6/2011 | Stone | |
| 2011/0168578 | A1 * | 7/2011 | Brunner | B65D 21/0215 206/63.5 |
| 2011/0214389 | A1 | 9/2011 | Paton | |
| 2013/0174498 | A1 * | 7/2013 | Hovren | E04G 21/1891 52/749.1 |
| 2013/0306633 | A1 * | 11/2013 | Belinda | B65D 51/24 33/562 |
| 2014/0123582 | A1 | 5/2014 | Stockton | |
| 2014/0217095 | A1 | 8/2014 | Scivoletto | |
| 2016/0018206 | A1 | 1/2016 | Hollis et al. | |
| 2019/0009962 | A1 * | 1/2019 | Pruitt, II | B65B 15/00 |

OTHER PUBLICATIONS

FastCap, "Jig-A-Deck System," https://www.fastcap.com/product/jig-a-deck-system>, accessed Jun. 2, 2019.

Kreg Deck Jig Archive, https://www.woodworkersinstitute.com/woodworking-crafts/kit-tools/ancillary-equipment/kreg-deck-jig/>, Dec. 13, 2012.

* cited by examiner

DECK CONSTRUCTION SPOTTER AND CONTAINER COMBINATION

CROSS-REFERENCE TO RELATED APPLICATION

This application claims priority to U.S. Provisional Application No. 62/888,590, titled Deck Construction Spotter and Container Combination, filed on Aug. 19, 2019, the entire content of which is incorporated herein by reference.

BACKGROUND

This disclosure relates generally to methods and tools for installing deck boards or planks. More particularly, this disclosure relates to tools and methods for obtaining the proper alignment and fastener locations during the installation of deck boards or planks and a related compact package.

Numerous new products, tools and hardware have been introduced to facilitate the construction of decks including the securement of deck boards to support members, such as joists, and to one another. The installation of deck boards is a labor-intensive process that requires careful attention to alignment, spacing, measuring and proper securement of each deck board. Typically, face-mounted deck boards are mounted over several spaced joists. One or more fasteners are driven through the top surface, into the deck board and threadably secured into each joist. Proper alignment of the deck boards and proper placement of the fasteners relative to each deck board and underlying joist is key to assembly of a finished deck that is structurally sound and aesthetically pleasing.

This is especially the case when a deck is assembled via deck planks with scalloped surfaces with crests and valleys. Aligning fasteners with the crests of the corrugations, rather than valleys, is immensely valuable for maintaining structural integrity of the resulting deck structure. The proper hardware and associated tools are invaluable for ensuring that the deck boards are installed in an effective process with high efficiency.

SUMMARY

Briefly stated, a package comprises a spotter and a complimentary container with one or more cavities for holding items, such as fasteners for installation using the spotter. The container may include a top member that closes a bottom member in a clamshell arrangement. The spotter includes an elongate web and opposite flanges, each flange having a pair of laterally spaced legs that define a recess therebetween. The recess is sized to accommodate the lateral thickness of an underlying joist with a deck plank to be installed lying beneath the spotter web. The web defines a pair of holes that are positioned to align with crests of a scalloped deck plank. A fastener can be driven through a hole to attach the deck plank to a joist with a portion of the fastener shank extending through the crest for optimal strength and attachment integrity. A support member extends downward from the web and abuts the top surface of the deck plank, thereby providing spacing between the web and plank to serendipitously transform the web into a handle.

BRIEF DESCRIPTION OF THE DRAWINGS

Aspects of the preferred embodiment will be described with reference to the Drawing, where like numerals reflect like elements.

DETAILED DESCRIPTION

Figure 1:
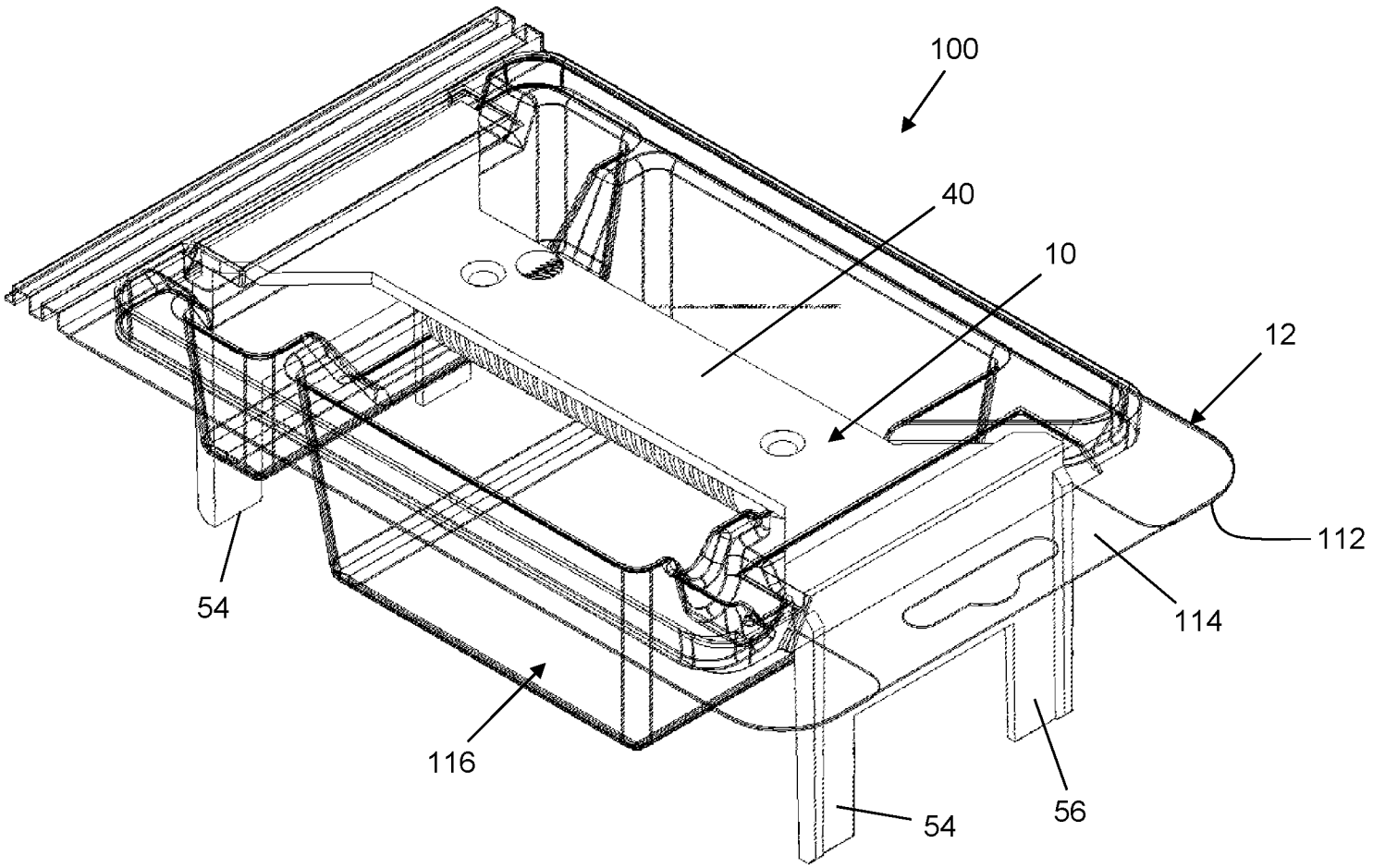
FIG. 1 is a perspective view of the package in accordance with the disclosure.

Among the benefits and improvements disclosed herein, other objects and advantages of the disclosed embodiments will become apparent from the following wherein like numerals represent like parts throughout the several figures. Detailed embodiments of a deck construction spotter and container combination are shown and described; however, it is to be understood that the disclosed embodiments are merely illustrative of the invention that may be embodied in various forms. In addition, each of the examples given in connection with the various embodiments of the invention which are intended to be illustrative, and not restrictive.

Throughout the specification and claims, the following terms take the meanings explicitly associated herein, unless the context clearly dictates otherwise. The phrase "in some embodiments" as used herein does not necessarily refer to the same embodiment(s), though it may. The phrases "in another embodiment" and "in some other embodiments" as used herein do not necessarily refer to a different embodiment, although it may. Thus, as described below, various embodiments may be readily combined, without departing from the scope or spirit of the invention.

In addition, as used herein, the term "or" is an inclusive "or" operator, and is equivalent to the term "and/or," unless the context clearly dictates otherwise. The term "based on" is not exclusive and allows for being based on additional factors not described, unless the context clearly dictates otherwise. In addition, throughout the specification, the meaning of "a," "an," and "the" include plural references. The meaning of "in" includes "in" and "on."

Further, the terms "substantial," "substantially," "similar," "similarly," "analogous," "analogously," "approximate," "approximately," and any combination thereof mean that differences between compared features or characteristics is less than 25% of the respective values/magnitudes in which the compared features or characteristics are measured and/or defined.

With reference to the drawings wherein like numerals represent like parts throughout the several figures, a deck construction spotter is generally designated by the numeral 10 and an associated container is generally designated as 200. The container/spotter combination package is identified with reference numeral 100. The spotter 10 is particularly adapted to provide the proper placement relative to both a deck plank and an underlying support member (i.e., joist) for driving a fastener F through the plank P into the joist for a deck assembly. In a particularly preferred embodiment, the spotter 10 is configured to align fasteners with peaks in scalloped deck planks, like the plank shown as reference numeral 300 in FIG. 16.

Figure 16:
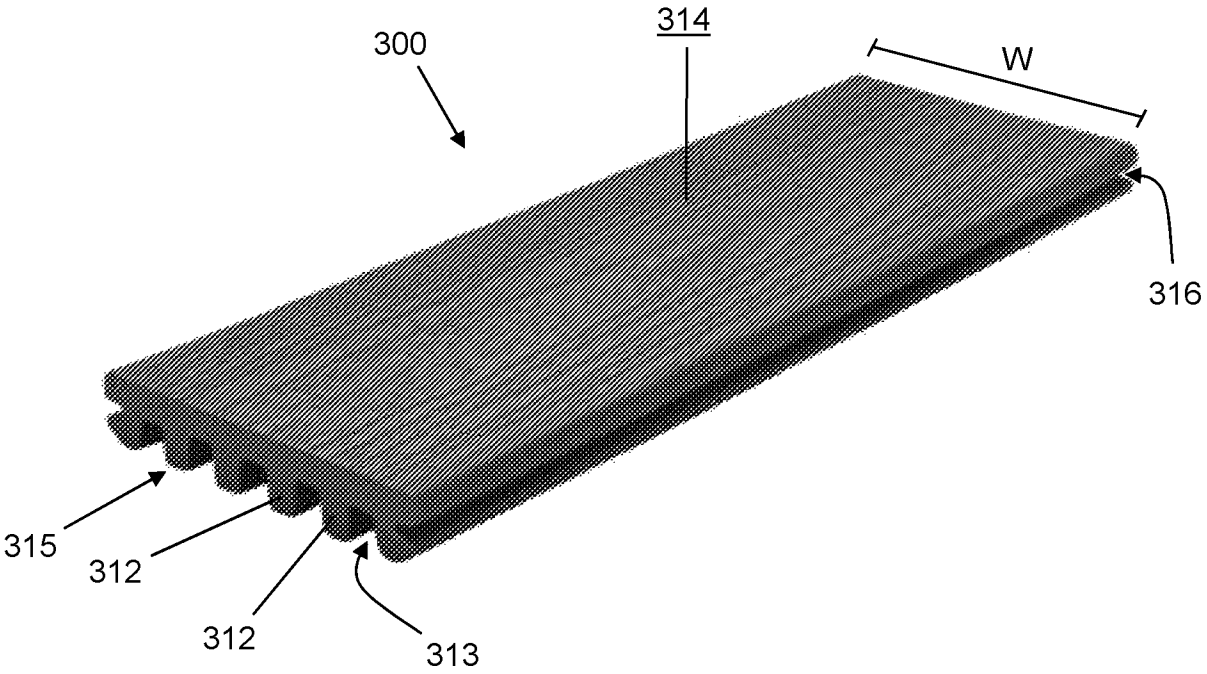
FIG. 16 shows a representative scalloped decking plank which the disclosed embodiments are particularly configured to install.
Figure 17:
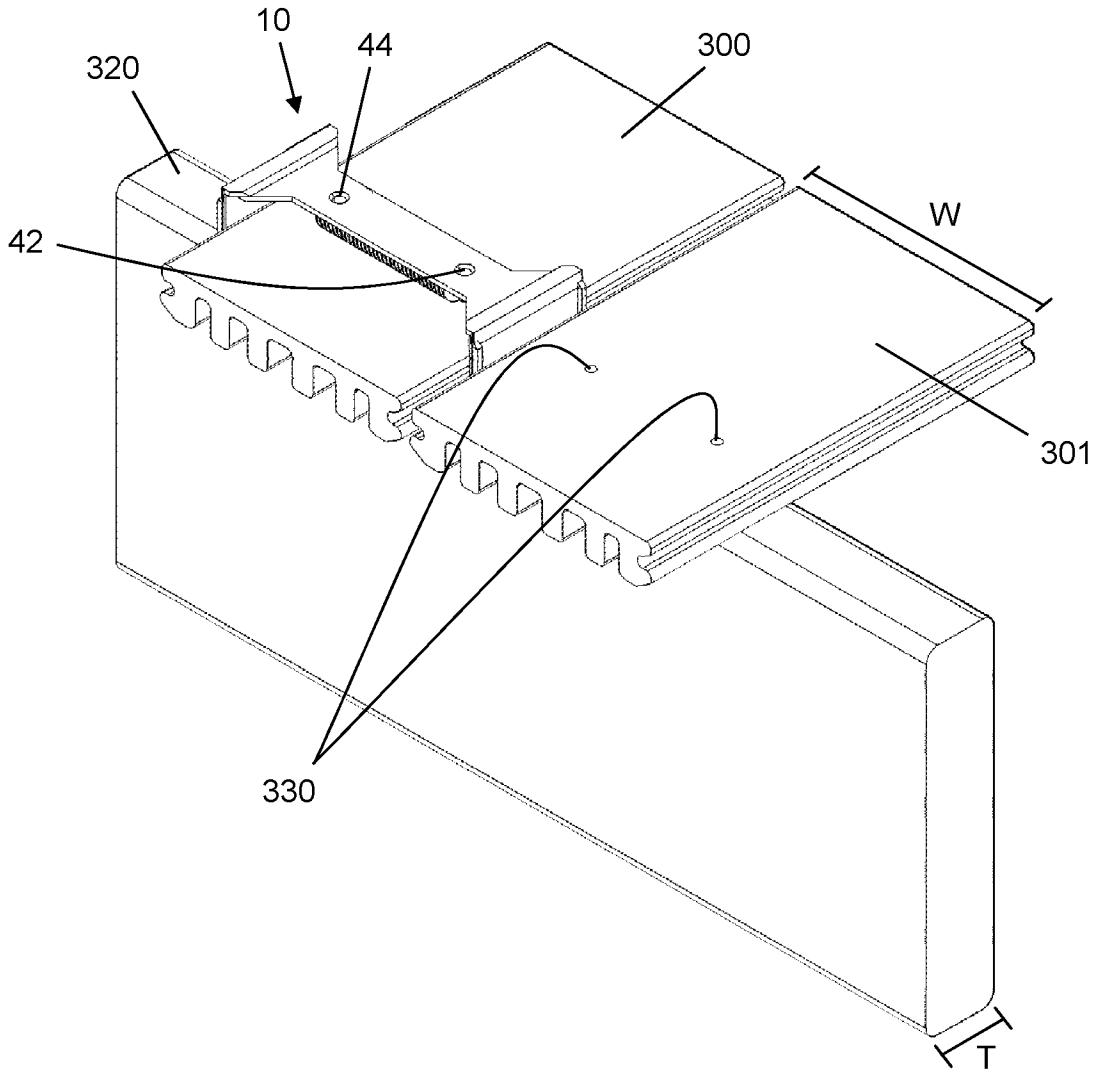
FIG. 17 is a representation of a deck plank installation using the disclosed spotter.
Figure 18:
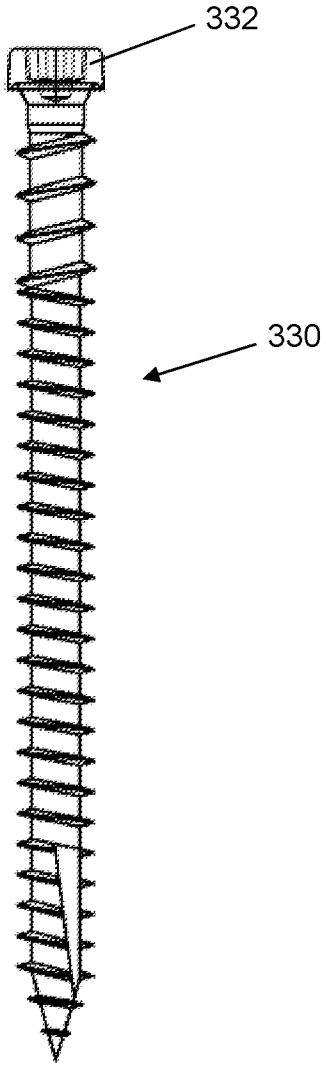
FIG. 18 shows a representative fastener for use with the disclosed package and spotter.

In FIG. 17, a representative joist 320 is illustrated in conjunction with a pair of scalloped deck planks 300 and 301. A representative elongate joist 320 extends longitudinally and has a thickness T which is generally uniform, such that the top surface has a thickness T. As known in the industry, numerous spaced parallel joists (not illustrated) are employed as support for deck planks in a decking structure. The deck planks 300 and 301 preferably have a uniform width W in the longitudinal direction ("longitudinal" is used relative to direction of extension of the joists) and may have a scalloped bottom 315. The scalloped bottom 315 is defined by a plurality of substantially parallel crests 312 spaced from one another along the width W by valleys 313. A representative deck plank 300 with which the spotter is configured to be used is shown in FIG. 16. A preferred embodiment of the spotter 10 is adapted for use with the Trex Enhance® decking system by Trex Company, Inc.

With reference to FIG. 17, the spotter 10 easily and efficiently mounts over the top surface 314 of a leading deck plank 300 to be installed and seats on the joist 320 with the joist 320 extending through the recess 55 defined between left and right legs 54 and 56 in the spotter 10. The guide 10 is configured to align the holes 42 and 44 defined in the web 40 of the guide 10 to lie directly above a crest 312 in the scalloped deck plank 300 for driving elongate fasteners 330 in a proper position through the crest. Preferred fasteners comprise the TrapEase® III and Cortex® deck screws and fasteners manufactured and marketed by OMG, Inc. of Agawam, Mass. The positioning of the holes 42 and 44 relative to the legs 54 and 56, and recess 55 also may provide placement of the fasteners 330 along the lateral midline of the joist (measured by the thickness T), which is optimal.

Figure 2:
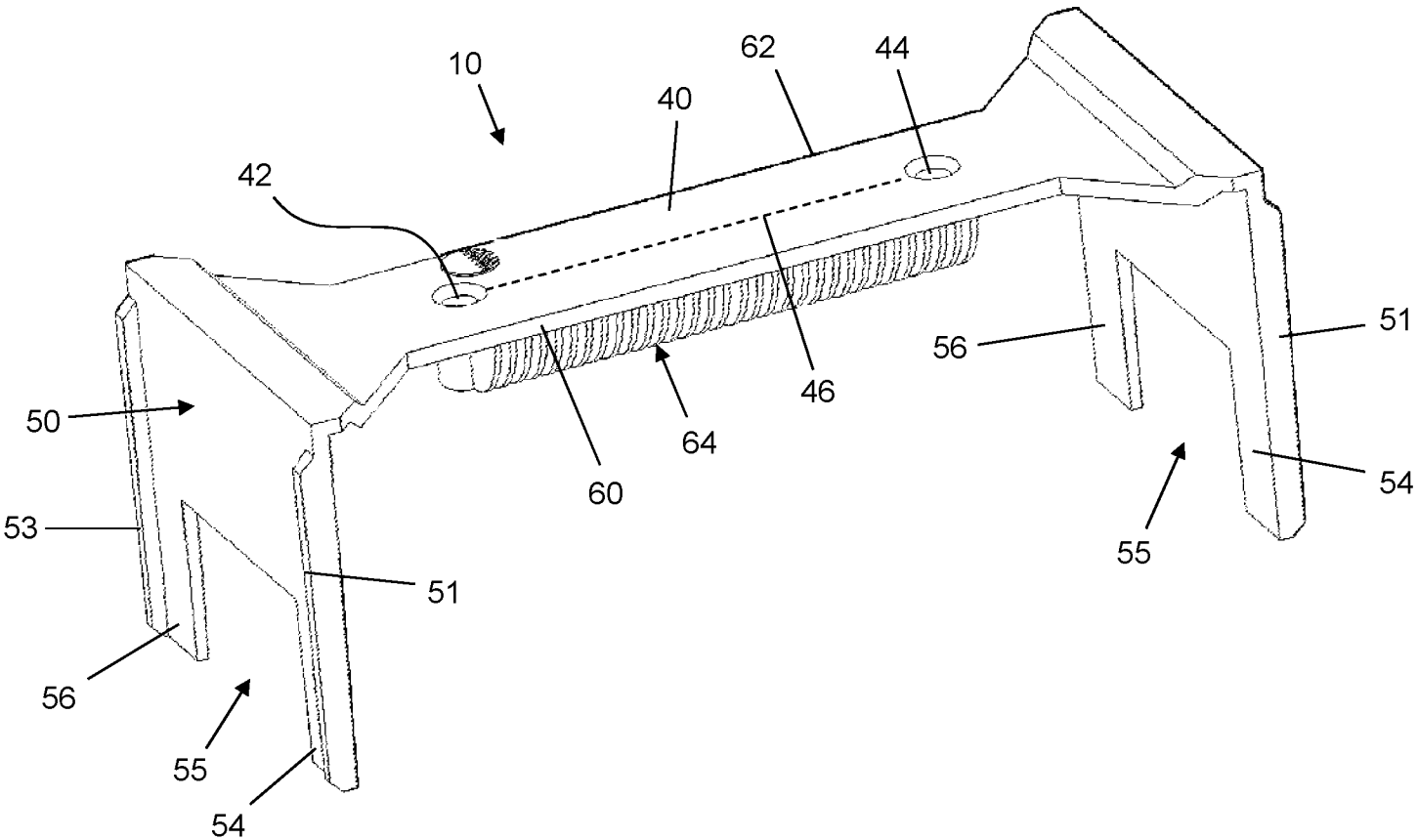
FIG. 2 is a top perspective view of the spotter of the package.
Figure 3:
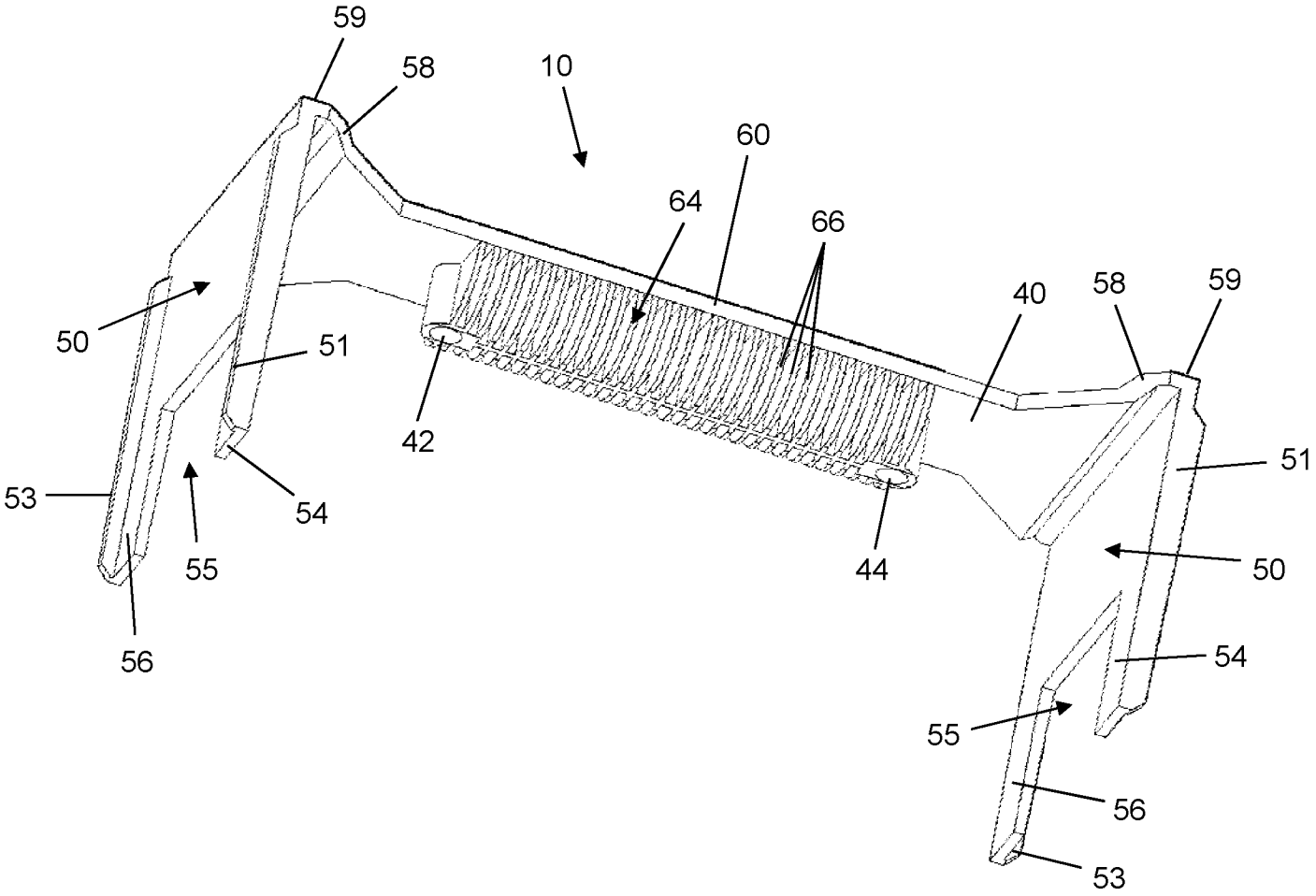
FIG. 3 is a bottom perspective view of the spotter.
Figure 4:
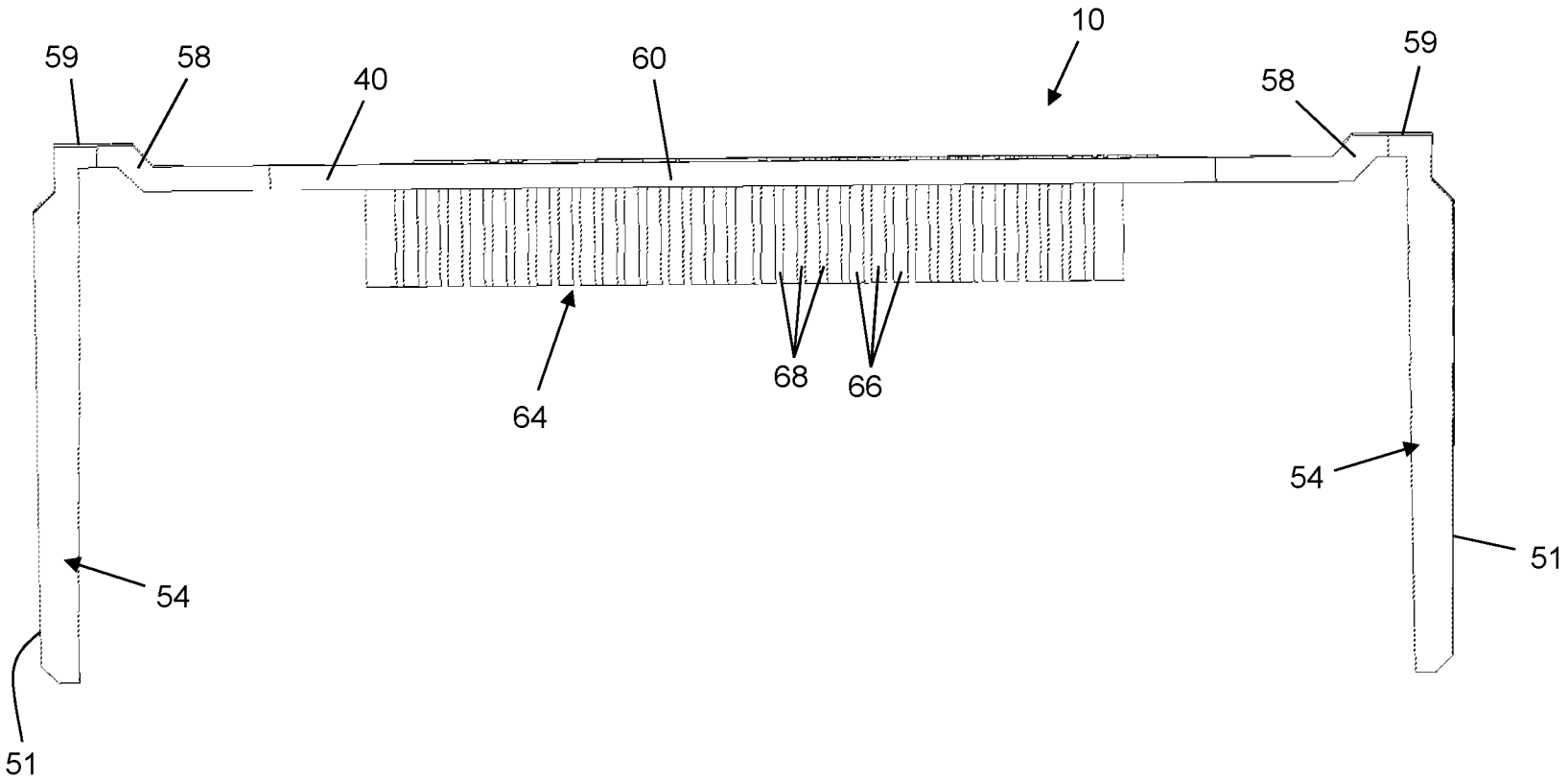
FIG. 4 is a side elevation view of the spotter.
Figure 5:
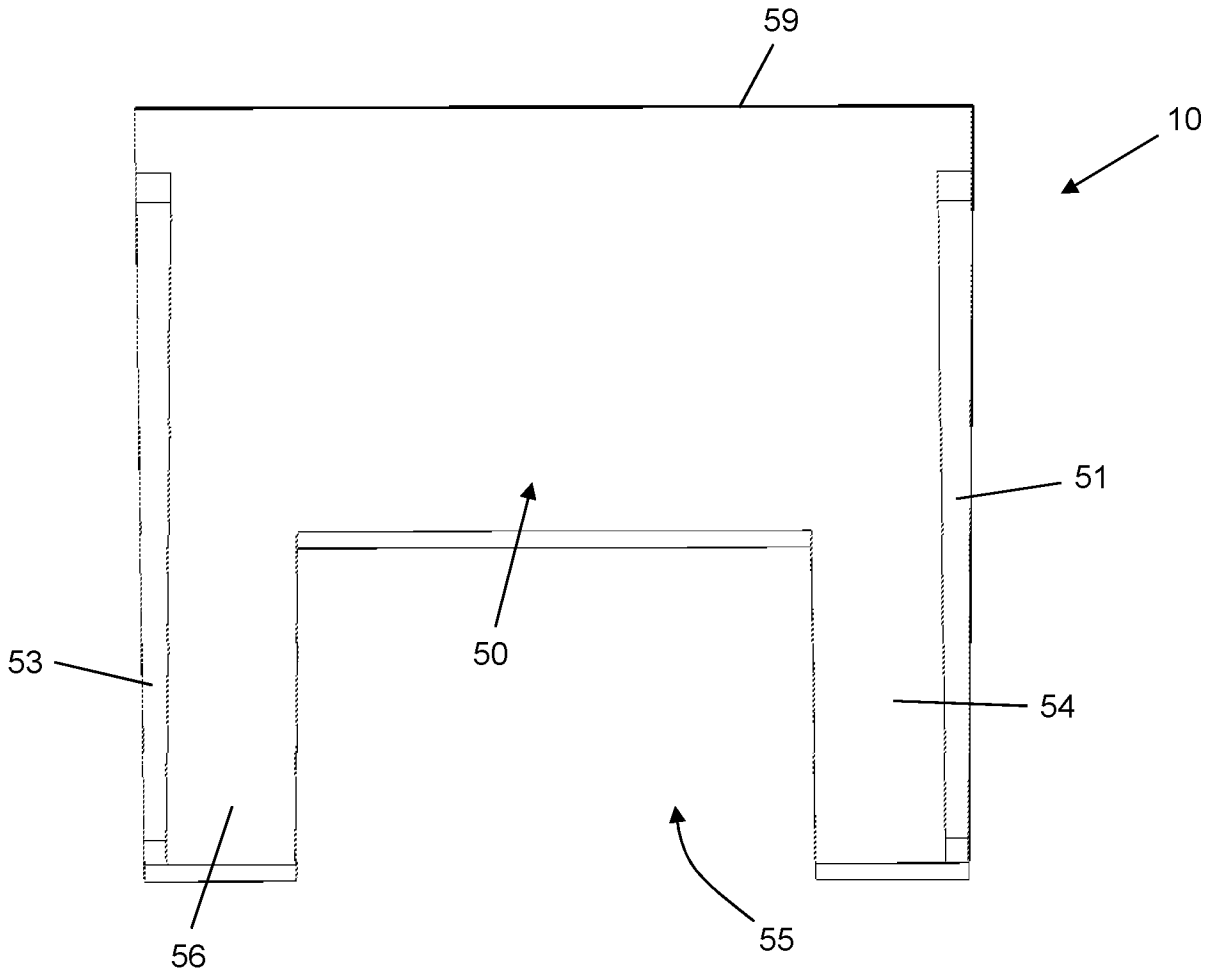
FIG. 5 is a rear elevation view of the spotter.

With reference to FIGS. 2-4, the spotter 10, which may be formed from any durable rigid material, such as metal or polymeric materials, for example, includes an upper web 40 extending longitudinally between opposite pairs of downwardly extending flanges 50. Each flange 50 includes a right and left leg 54, 56 that also extend downwardly. The web 40 defines holes 42, 44 extending therethrough configured to receive and guide a fastener 330 driven fully through the web 40 and into a given deck plank 300 to attach the plank to an underlying joist 320. The holes 42, 44 may be spaced equidistantly from the respective opposed end flanges 50 and respective opposed lateral edges 60, 62. The spotter 10 is not limited in terms of the number and exact positioning of the openings. Preferably, each of the holes 42, 44 is positioned such that a fastener driven through a respective opening is at least 1 inch away from the closest outer edge of the decking plank.

The two opposed flanges 50 extend downward generally perpendicular to the web 40. Each of the flanges 50 preferably define a generally rectangular recess 55 defined between a respective pair of legs 54, 56. Each of the recesses 55 is sized to accommodate the top edge thickness of the joist 320, and thus, the inner edges of the respective left and right legs 54, 56 are spaced a distance approximately equal to the thickness T of the joist 320. The flanges 50 may be generally parallel to one another and generally perpendicular to the top surface of the web 40, however, this preferred configuration is non-limiting. It will be appreciated that a plane through the medial axis 46 of the web 40 and perpendicular to the openings 42, 44 also passes at the midpoint between the legs 54, 56 in this preferred embodiment.

As can be seen in FIGS. 2-4, a ribbed support member 64 projects downwardly from the bottom surface of the web 40. The support member 64 comprises a plurality of ribs 66 spaced longitudinally from one another with spacing 68 between successive ribs. As shown most clearly in FIG. 3, the holes 42, 44 preferably extend through a portion of the support member 64, which provides enhanced stability when driving fasteners 330. The support member 64 is configured to abut the top surface 314 of a deck plank 300 when the spotter is mounted on the plank for installation, which thereby provides a vertical spacing between the top surface of the web 40 and the deck plank 300. This transforms the web 40 into a handle that is easily grippable by the user after driving of the fasteners.

As shown most clearly in the side view of FIG. 4, the flat web 40 transitions upward at each longitudinal end via a ramp 58 to an end shoulder 59 that defines an opposing edge from which the respective flanges 50 extend. In operation, the cooperative ramp and shoulder configurations enhance outward flexation of the flanges 50 relative to the web 40, which assists in maintaining a tight engagement with a respective plank 300 during installation as the flanges 50 naturally return inward and apply a moderate pinching or clamping force on the edges of the plank.

The spotter 10 is dimensioned so that the web 40 extends along the deck plank 300 and is self-centered on the joist 320 by the legs 54, 56 with the joist 320 extending through the recesses 55. Upon placement of the alignment guide, as illustrated in FIG. 17, the holes 42, 44 are aligned with the trailing deck plank 300 to be installed with each hole 42, 44 over a crest 312 for driving of fasteners through the respective holes and into the plank in alignment with a respective crest to attach the deck plank to the joist 320.

As shown in the Figures, each of the legs 54, 56 includes a spacing wing 51 and 53, respectively, projecting in the longitudinal direction. The spacing wings 51, 53 act as spacers between a leading plank 301, which is already attached to the joist, and the trailing plank 300 to ensure consistent and optimal parallel spacing between adjacent deck planks in the deck structure. The wings have a lateral length that may vary dependent upon the type of lumber used to construct the deck and the desired spacing between adjacent planks in a deck structure. In a preferred embodiment, the wings 70 and 72 extend in the longitudinal direction within a range of approximately 1/16" to approximately 1/8". In another embodiment, the wings 70 and 72 extend in the longitudinal direction within a range of approximately 3/16" to approximately 1/4".

Preferably, the holes 42, 44 are substantially circular and have a substantially equal diametral dimension that fully accommodates the head 332 of a fastener 330. However, the exact dimension of the holes relative to the fastener is non-limiting.

Figure 6:
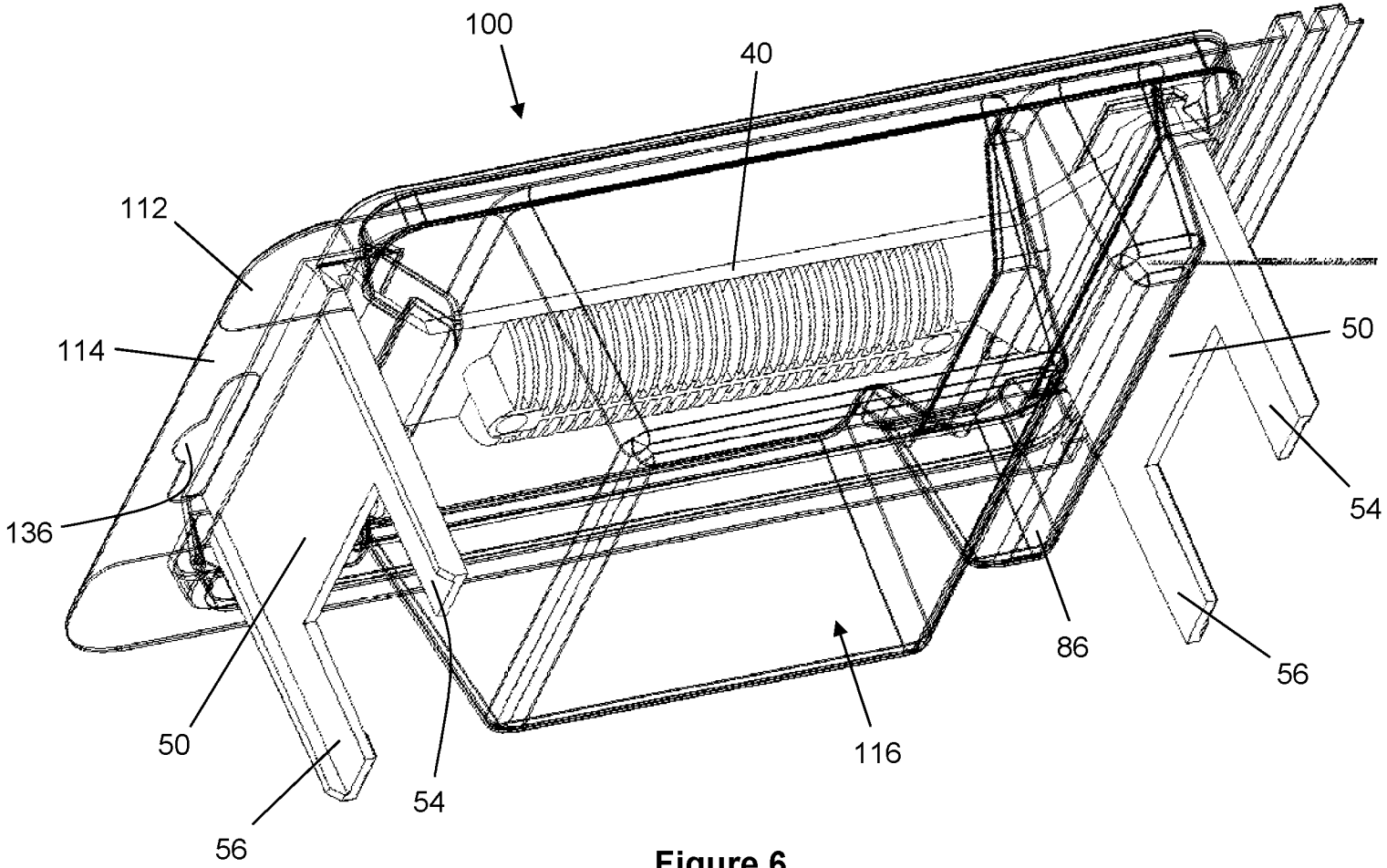
FIG. 6 is a bottom perspective view of the package of FIG. 1.

Importantly, with reference to FIGS. 1 and 6, the spotter 10 is configured to cooperate with a container 200 to form a combination package 100. As shown, the legs 54, 56 are exposed from the package 100, as will be discussed in further detail below.

Figure 7:
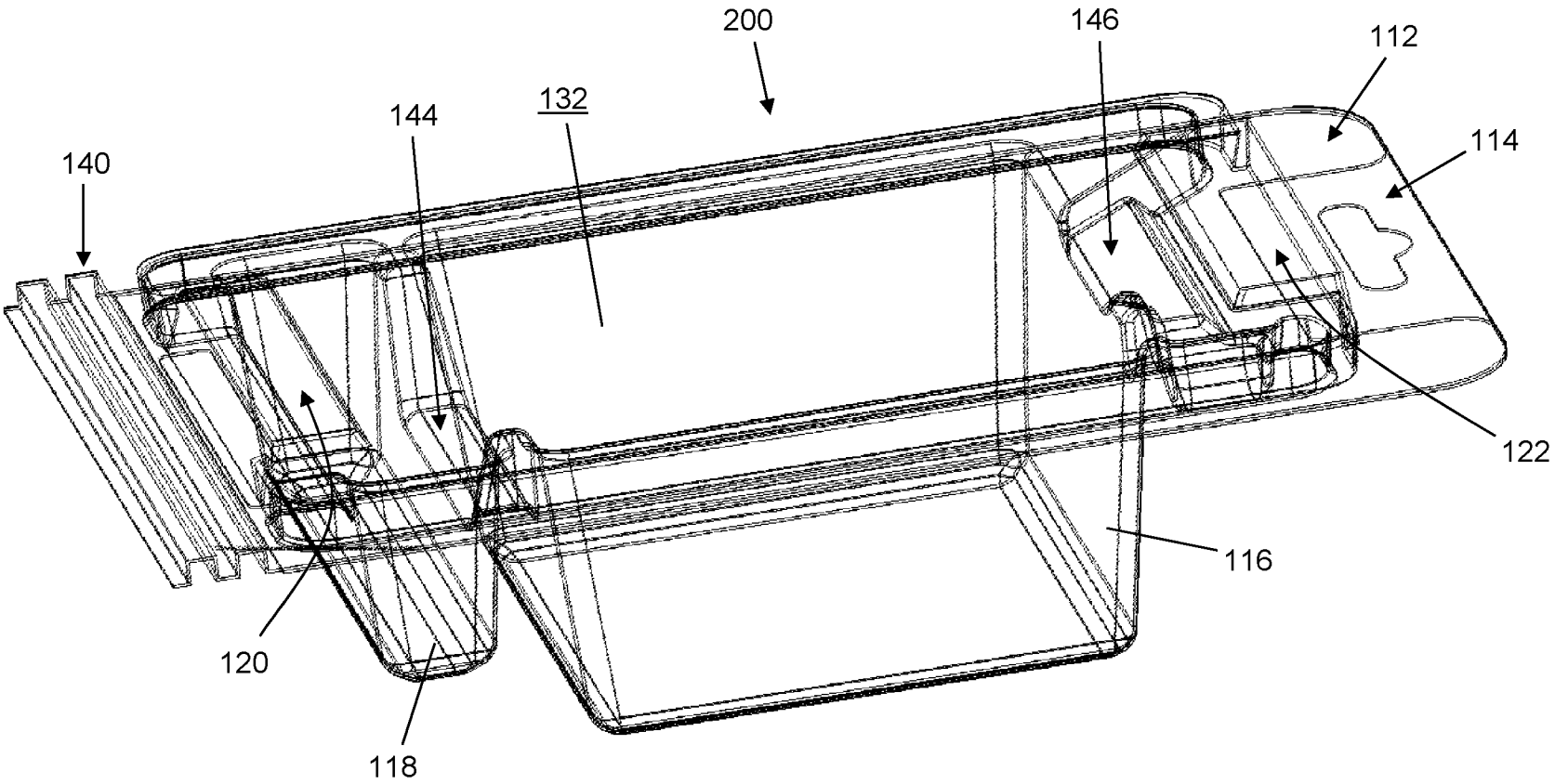
FIG. 7 is a top perspective view of the container of the package.
Figure 8:
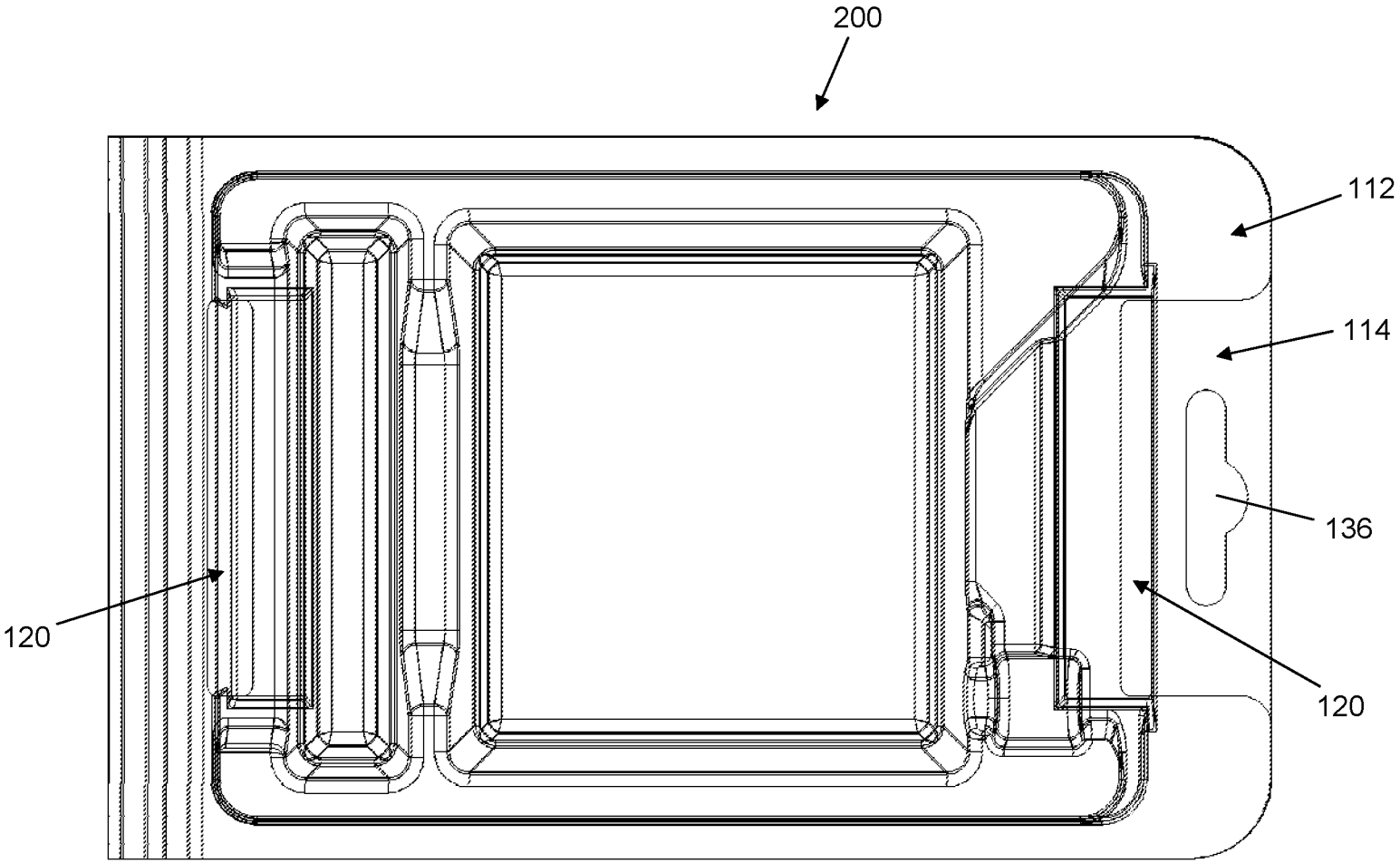
FIG. 8 is a top elevation view of the container.
Figure 9:
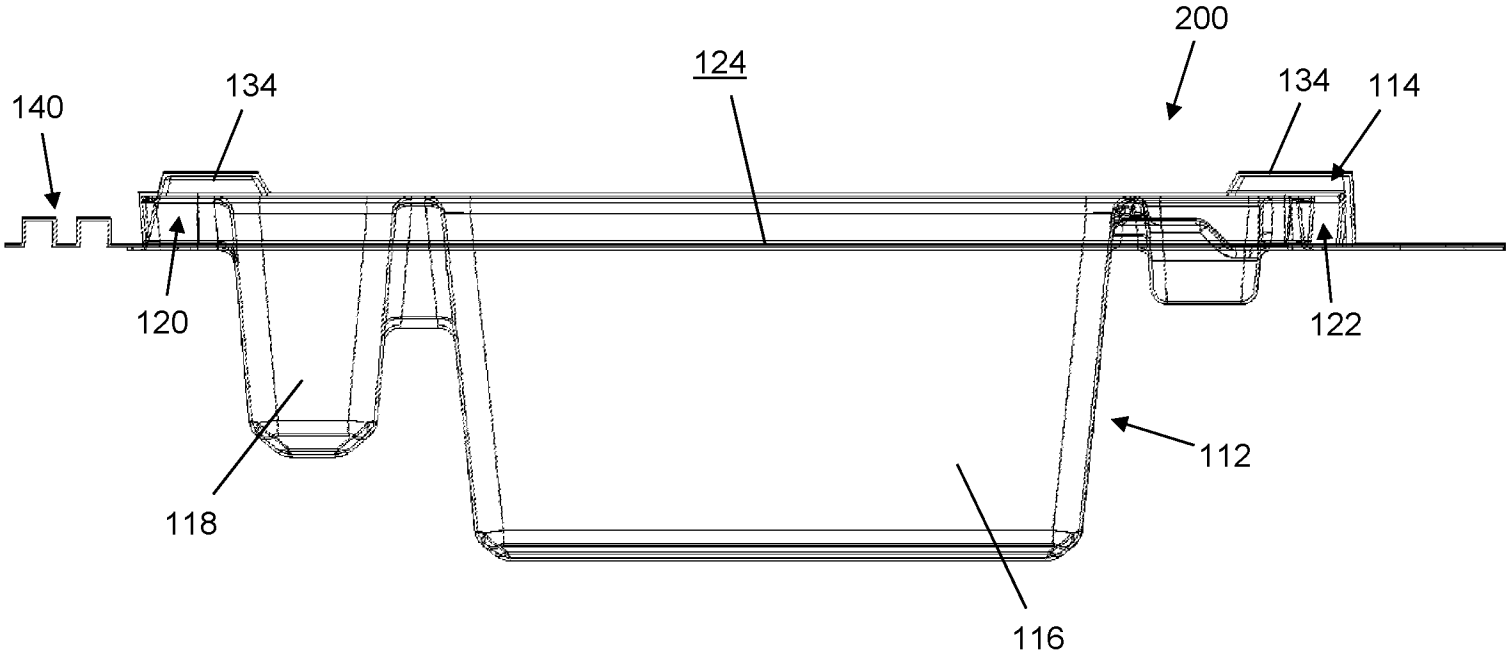
FIG. 9 is a side elevation view of the container.

FIGS. 7-9 depict a container 200 configured for use with the spotter 10 to form the package 100. The container 200 has a "clam shell" design, including a top member 114 and bottom member 112 that are welded together at a joining section 140 that may allow the top member 114 to open from the bottom member 112 at a hinge formed at the joining section to allow access to the interior of the container 200. In another embodiment, the top member fully disengages from the bottom member to open the container (not depicted).

Figure 10:
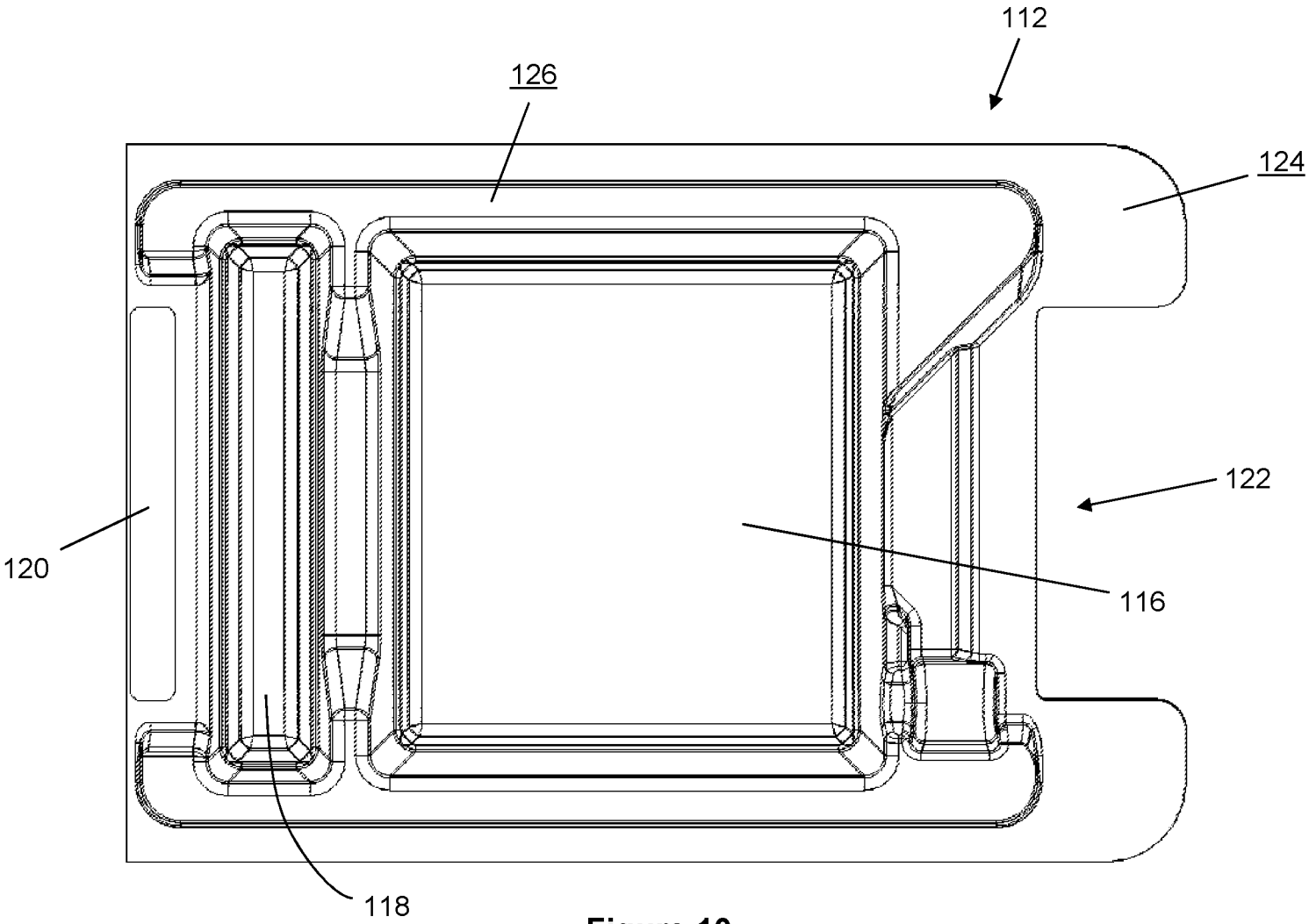
FIG. 10 is a top perspective view of the bottom member of the container.
Figure 11:
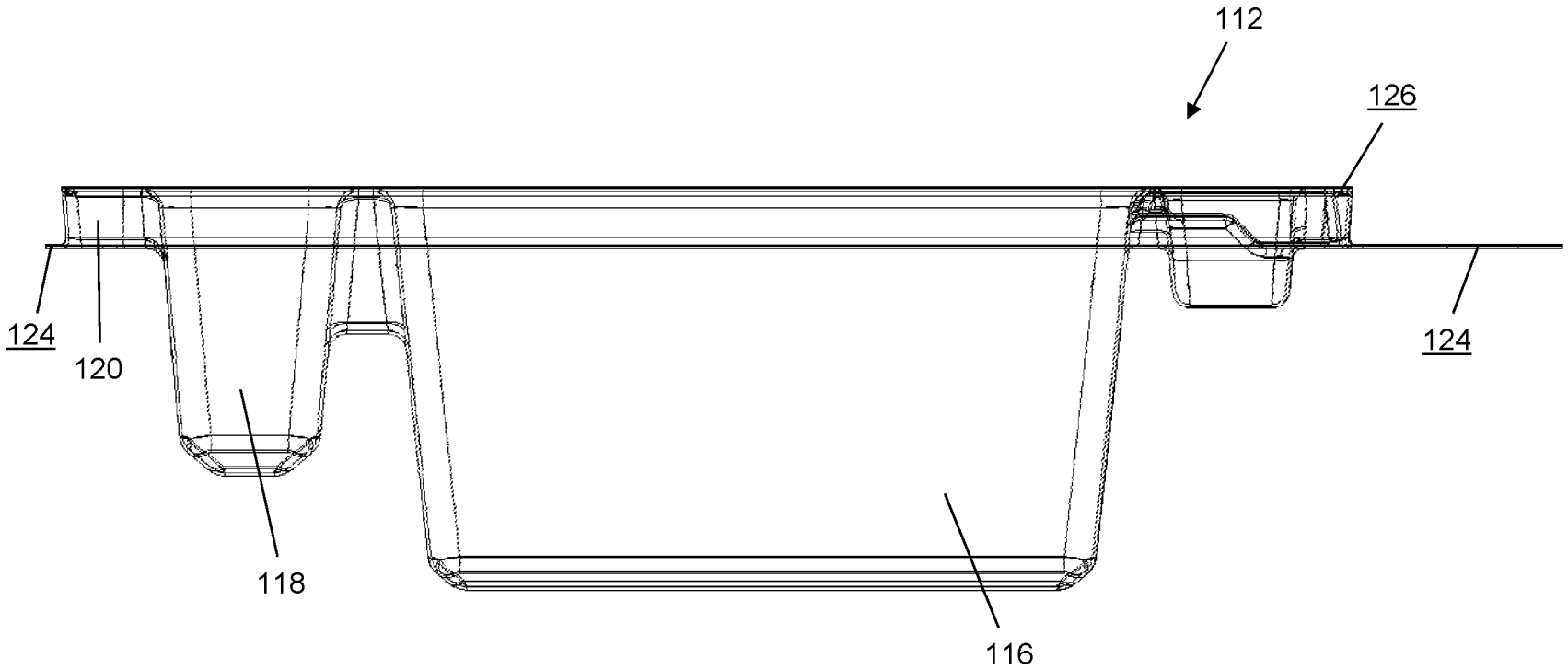
FIG. 11 is a side elevation view of the bottom member.
Figure 12:
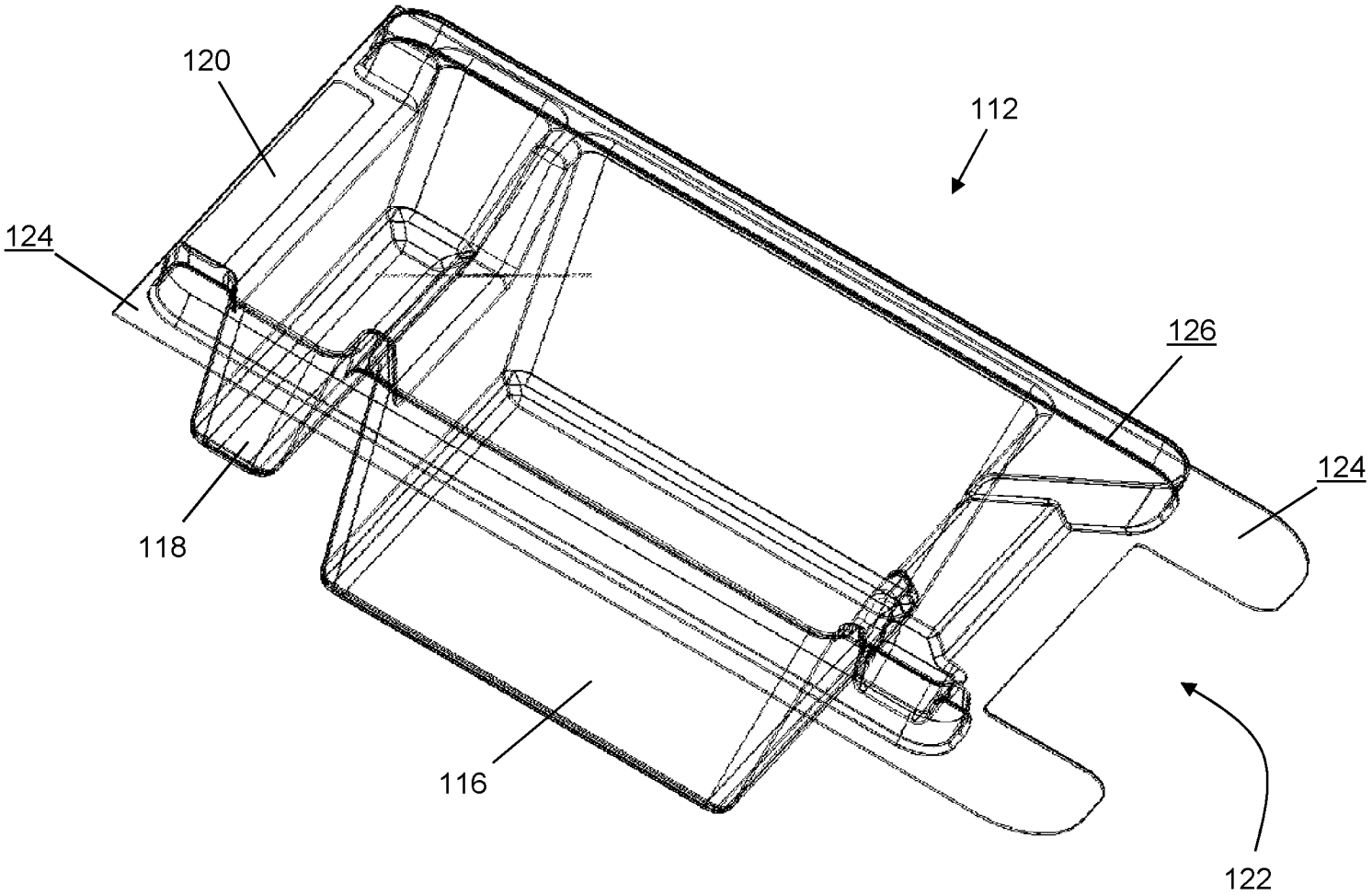
FIG. 12 is a top perspective view of the bottom member.

FIGS. 10-12 depict the bottom member 112 alone. As shown, the bottom member includes a primary cavity 116 and optionally one or more secondary cavities 118. In use, typically, the primary cavity 116 houses a plurality of fasteners 330 for use in construction of a decking structure using the disclosed spotter 10 to install planks 300, 301. The bottom member 112 defines a flat outer surface 124 along its periphery with a ledge 126 projecting upwards at a position inward of the flat outer surface 124. The outer surface 124 includes a laterally elongate slot 120 at a first longitudinal end of the bottom member 112 sized generally to receive a flange 50 from the spotter 10. The opposite longitudinal end includes a second slot 122 which may optionally extend fully through the opposite edge, as depicted in the embodiment of FIG. 10. On opposite ends of the primary cavity 116 are defined U-shaped slots 144, 146 that are sized to allow a portion of the spotter 10 to extend longitudinally through to form a cradled engagement between the spotter and the respective slot 144, 146. One or both of the U-shaped slots 144, 146 may include a ramped section configured to support the spotter 10 beneath one of the ramps 58.

Figure 13:
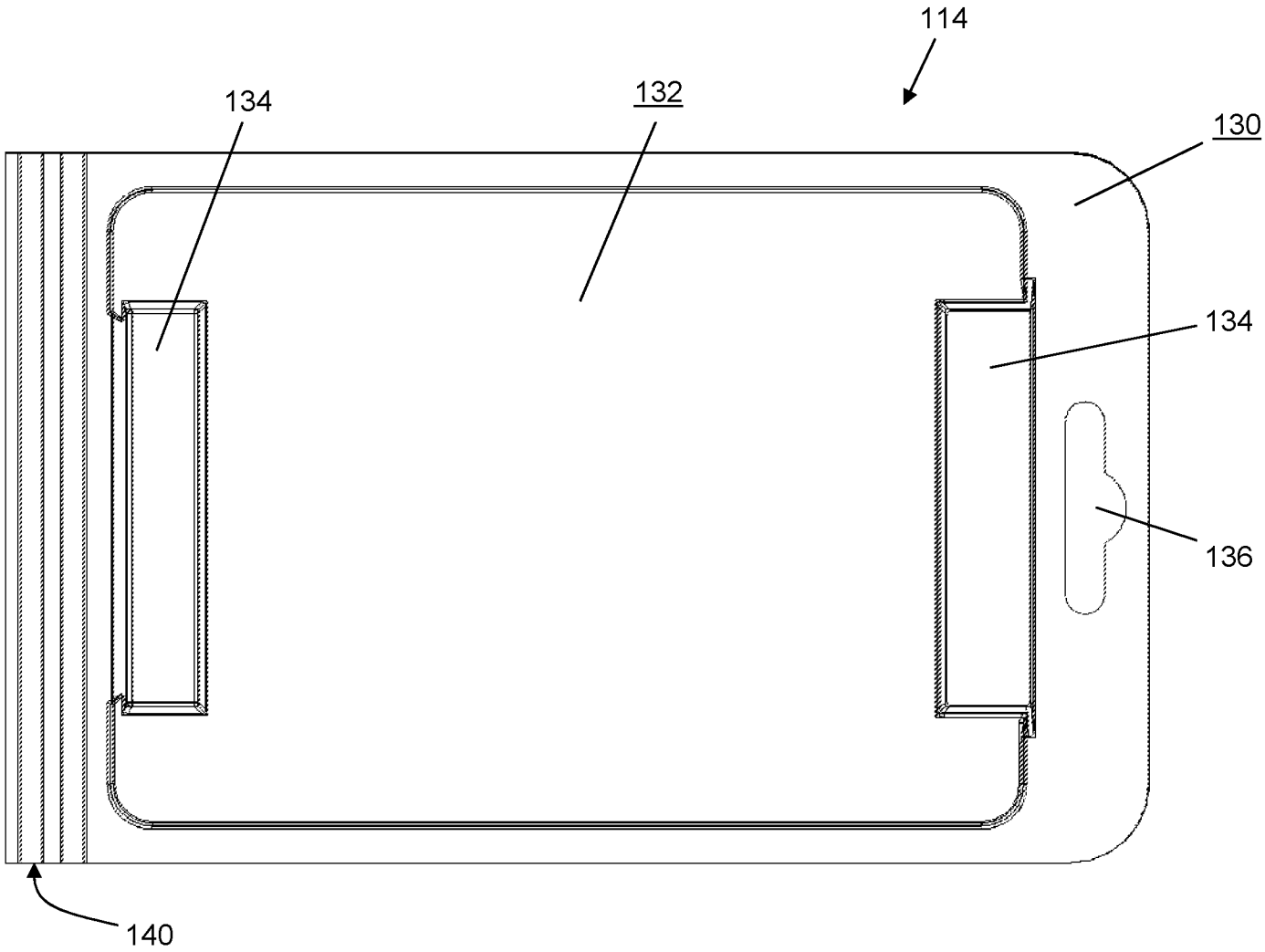
FIG. 13 is a top elevation view of the top member of the container.
Figure 14:
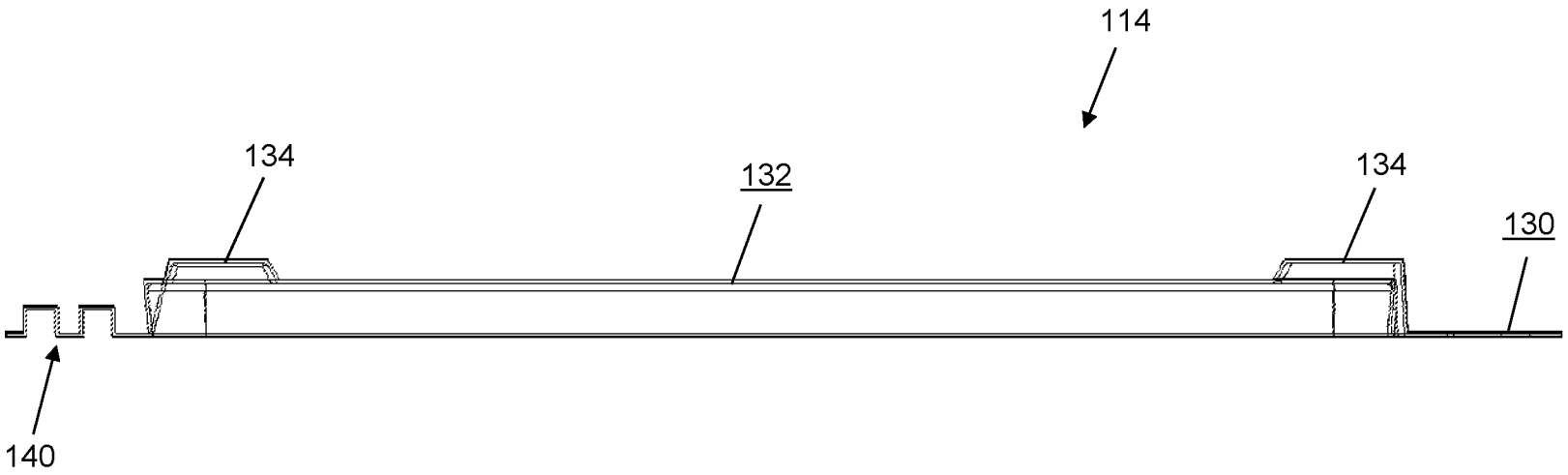
FIG. 14 is a side elevation view of the top member.
Figure 15:
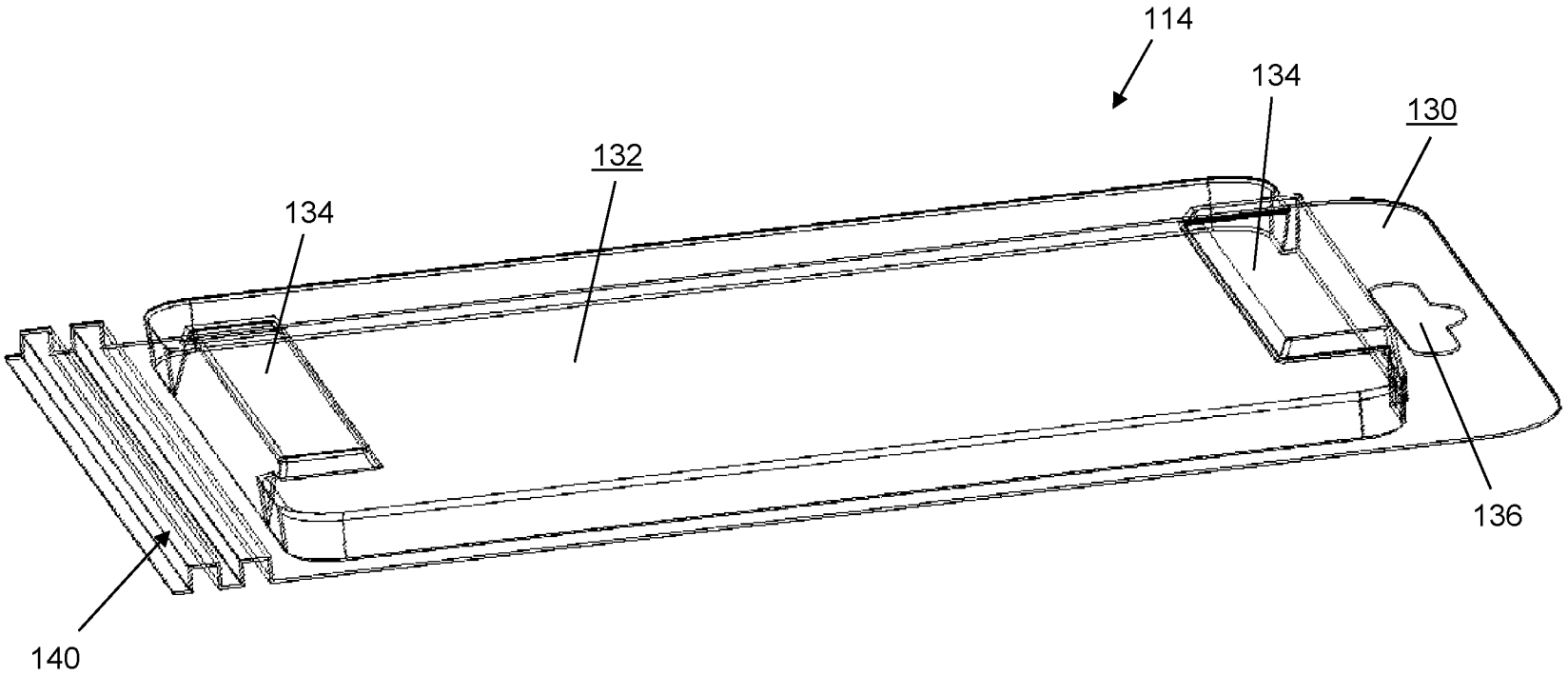
FIG. 15 is a top perspective view of the top member.

FIGS. 13-15 show the top member 114 of the container 200 in isolation. The top member includes a flat outer surface 130 around its periphery with an elevated plateau 132 inward of the outer surface 130. With reference to FIG. 14, the top member 114 also includes an elevated table 134 on opposite longitudinal ends of the plateau 132. As shown in the depictions of the container 200 in FIGS. 7-9, the plateau 132 is sized to closely mate with the outer edge and surface of the ledge 126 in the bottom member 112 to close the open top of the bottom member, and in particular the open cavity 116. The top member may also define an opening 136, hook or similar configured to assist in hanging the package 100 in a retail setting. When the container 200 is closed, the top member 114 securely engages the bottom member 112 via the plateau 132 clipping to the ledge 126.

In a typical configuration of the package 100, the primary cavity 116 is filled with fasteners 330, optionally with other items, such as installation instructions for example, in a secondary cavity 118. The spotter 10 is mounted over the fasteners 330 and extends longitudinally through in the U-shaped slots 144 and 146 with one of the opposite flanges 50 extending downward through each longitudinal slot 120, 122 in the bottom member 112. In the depicted preferred embodiment shown in FIG. 6, the flanges 50 are exposed from the container 200. However, other embodiments exist wherein the bottom member 112 includes portions that envelop one or both of the flanges 50. The top member 114 is clamped closed via the hinge at the joining section 140 with the top member outer surface 130 in face-to-face abutment with the bottom member outer surface 124 and the plateau 132 over the ledge 126.

While preferred embodiments have been set forth for purposes of illustration, the foregoing description should not be deemed a limitation of the invention herein. Accordingly, various modifications, adaptations and alternatives may occur to one skilled in the art without departing from the spirit of the invention and scope of the claimed coverage.

What is claimed is:

1. A construction spotter comprising:

a web extending in a longitudinal direction and between opposite lateral edges defining a lateral extent, the web having a top surface and bottom surface, and defining a pair of longitudinally spaced holes extending through from the top surface to bottom surface;

a first flange and a second flange longitudinally spaced from one another, the first and second flanges extending downwardly from the web, each flange including a pair of laterally spaced apart legs defining a passthrough recess therebetween, each leg of the respective pairs of legs having an outer lateral edge with a distance between the outer lateral edges of a given pair of legs defining a lateral extent of each flange; and a support member extending downwardly from the bottom surface of the web and extending along at least a portion of the longitudinal distance between the first flange and second flange, wherein the lateral extent of each flange is greater than the lateral extent of the web, and the spotter is positionable with the web extending across a decking plank and a beam underlying the decking plank extending through the passthrough recess between the legs of each respective flange, and the support member abutting a surface of the decking plank to provide a clearance between the top surface of the web and the surface of the decking plank.

2. The construction spotter of claim 1, wherein the flanges are outwardly flexible relative to the web in the longitudinal direction.

3. The construction spotter of claim 1, comprising at least one spacing wing extending from at least one of the legs, the at least one spacing wing being configured to provide a spacing between a leading decking plank and an adjacent trailing decking plank.

4. The construction spotter of claim 3, wherein at least one of the at least one spacing wing extends from each of the legs.

5. The construction spotter of claim 3, wherein the at least one spacing wing extending in the longitudinal direction within a range of approximately 1/16 inch to approximately 1/4 inch.

6. The construction spotter of claim 1, wherein each of the holes extends through the support member.

7. The construction spotter of claim 1, wherein the support member comprises a series of longitudinally spaced ribs, the ribs extending laterally.

8. The construction spotter of claim 7, wherein the ribs have an arced contour that is convex in the downward direction.

9. The construction spotter of claim 1, comprising a ramp that transitions upwardly from the web to an end shoulder from which each flange extends downwardly.

10. The construction spotter of claim 9, wherein the ramp allows longitudinally outward flexation of the flanges relative to the web.

11. The construction spotter of claim 10, wherein the spotter is sized relative to the decking plank and shaped such that a natural inward return force after outward flexation of the flanges applies a moderate clamping force to front and rear edges of the decking plank.

12. The construction spotter of claim 1, wherein each hole of the pair of holes extends through a portion of the support member.

13. The construction spotter of claim 1, wherein the web extends longitudinally between a first end and a second end, further comprising a ramp on each longitudinal end of the web, each ramp transitioning upward in the longitudinal direction between one respective end of the web and a respective flange.

14. The construction spotter of claim 13, wherein the support member extends longitudinally between a first end and a second end defining a support member longitudinal extent that is less than a distance between the first end and second end of the web.

15. The construction spotter of claim 12, wherein a portion of the support member circumscribes each respective hole in its entirety.

16. The construction spotter of claim 1, wherein each hole extends through a portion of the support member with a portion of the support member entirely circumscribing the respective hole.

17. The construction spotter of claim 1, wherein the web defines a handle grippable by a user.

18. A construction spotter, comprising:

a web extending between opposite ends and defining a top surface and a pair of spaced apart alignment holes;

a first flange proximate one of the opposite ends of the web and defining a first passthrough recess, the first flange extending in a downward direction relative to the top surface;

a second flange proximate the other of the opposite ends of the web and defining a second passthrough opening substantially aligned with the first passthrough opening, the second flange extending in the downward direction relative to the top surface; and a support member extending downward from one side of the web, the support member having an arced contour that is convex in the downward direction.

19. The construction spotter of claim 18, wherein each of the holes extends through a portion of the support member.

20. The construction spotter of claim 18, wherein the support member comprises a plurality of longitudinally spaced ribs.

* * * * *